US009290896B2

(12) United States Patent
Bianco

(10) Patent No.: US 9,290,896 B2
(45) Date of Patent: Mar. 22, 2016

(54) MODULAR GATE SYSTEM AND INSTALLATION METHOD THEREFOR

(71) Applicant: James S. Bianco, Suffield, CT (US)

(72) Inventor: James S. Bianco, Suffield, CT (US)

(73) Assignee: Control Module, Inc., Enfield, CT (US)

( * ) Notice: Subject to any disclaimer, the term of this patent is extended or adjusted under 35 U.S.C. 154(b) by 0 days.

(21) Appl. No.: 14/208,274

(22) Filed: Mar. 13, 2014

(65) Prior Publication Data

US 2014/0352215 A1 Dec. 4, 2014

Related U.S. Application Data

(60) Provisional application No. 61/778,691, filed on Mar. 13, 2013.

(51) Int. Cl.

| | |
|---|---|
| ***E01F 13/00*** | (2006.01) |
| ***E01F 15/04*** | (2006.01) |
| ***E01F 13/08*** | (2006.01) |
| ***G08G 1/017*** | (2006.01) |
| ***G08G 1/095*** | (2006.01) |

(52) U.S. Cl.

CPC ..... *E01F 15/04* (2013.01); *E01F 13/08* (2013.01); *G08G 1/017* (2013.01); *G08G 1/095* (2013.01)

(58) Field of Classification Search

CPC ..... E01F 15/04; E01F 13/08
USPC ..... 49/49; 404/6, 11
See application file for complete search history.

(56) References Cited

U.S. PATENT DOCUMENTS

| | | | | |
|---|---|---|---|---|
| 3,596,241 | A * | 7/1971 | Migneault | 340/932.2 |
| 3,861,319 | A * | 1/1975 | Gelhard et al. | 104/124 |
| 5,101,200 | A * | 3/1992 | Swett | 340/937 |
| 6,040,785 | A * | 3/2000 | Park et al. | 340/928 |
| 7,856,915 | B1 * | 12/2010 | Anderson et al. | 89/36.07 |
| 7,942,602 | B2 * | 5/2011 | Bunk et al. | 404/6 |
| 2002/0004741 | A1 * | 1/2002 | Yoshida | 705/13 |
| 2004/0076468 | A1 * | 4/2004 | McKay et al. | 404/6 |
| 2004/0232054 | A1 * | 11/2004 | Brown et al. | 209/552 |
| 2005/0279831 | A1 * | 12/2005 | Robinson et al. | 235/384 |
| 2006/0251498 | A1 * | 11/2006 | Buzzoni et al. | 414/139.9 |
| 2007/0087756 | A1 * | 4/2007 | Hoffberg | 455/450 |
| 2007/0090334 | A1 * | 4/2007 | Laws et al. | 256/24 |
| 2007/0210192 | A1 * | 9/2007 | Piatti | 239/750 |
| 2009/0032788 | A1 * | 2/2009 | Adler | 256/11 |
| 2009/0043506 | A1 * | 2/2009 | Breed | 701/214 |
| 2009/0045300 | A1 * | 2/2009 | Vander Griend | 248/62 |
| 2010/0097206 | A1 * | 4/2010 | Jung et al. | 340/539.1 |
| 2010/0207760 | A1 * | 8/2010 | Stomski | 340/540 |
| 2012/0154164 | A1 * | 6/2012 | Turnock | 340/669 |
| 2013/0006723 | A1 * | 1/2013 | McGowan, III | 705/13 |
| 2013/0185001 | A1 * | 7/2013 | Cardoso et al. | 702/24 |

(Continued)

FOREIGN PATENT DOCUMENTS

| | | | |
|---|---|---|---|
| GB | 12254 | * 0/1910 | 404/6 |
| JP | 11-350436 | * 12/1999 | |

(Continued)

*Primary Examiner* — Jerry Redman
(74) *Attorney, Agent, or Firm* — Alix, Yale & Ristas, LLP

(57) ABSTRACT

A modular gate system for a vehicle travel lane employs a plurality of various modules to control the traffic flow and to sense and monitor the vehicles traversing the travel lane. The power and communication for the modules are provided by power and communication lines enclosed in a conduit which is mounted to an elevated rail.

13 Claims, 7 Drawing Sheets

(56) References Cited

U.S. PATENT DOCUMENTS

| | | | | |
|---|---|---|---|---|
| 2013/0266185 | A1* | 10/2013 | Bulan et al. | 382/104 |
| 2014/0208207 | A1* | 7/2014 | Li | 715/719 |

FOREIGN PATENT DOCUMENTS

| | | | |
|---|---|---|---|
| JP | 2005-276772 | * | 10/2005 |
| WO | WO 2012169040 A1 | * | 12/2012 |
| WO | WO 2013/038033 A1 | * | 3/2013 |

* cited by examiner

MODULAR GATE SYSTEM AND INSTALLATION METHOD THEREFOR

BACKGROUND

This disclosure relates generally to gate systems for controlling the entrance and exit of vehicles to and from a facility. More particularly, this disclosure relates to automatic gate systems which are employed to automatically control the traffic flow to and from a facility and to automatically identify the operator and the vehicle.

The requirements for a gate system and the automatic identification of personnel and vehicles can vary from facility to facility. It is highly desirable that a vehicle gate system be provided which efficiently incorporates various modules that can be selected and installed to meet the given facility requirement. An additional obstacle to installing automatic gate and control systems resides in providing the required power and communication connections for the systems. Conventional construction techniques practically require that the power and communication lines be placed underground or below the facility floor. These technologies typically require expensive penetration through concrete or pavement to complete the hardware connections. Typically, such automatic gate systems must be designed for a specific locale given the various in-place features of the facility.

SUMMARY

Briefly stated, a modular vehicle gate system comprises a rail system having a plurality of supports and at least one rail unit supported by the supports to extend generally linearly to define an elevated rail. At least two modules are mounted adjacent, against and/or to the rail at spaced positions along the rail. The modules constitute one or more modules selected from the group of an anti-tailgate module, a personal identification module, a vehicle identification module, a gate module or a barrier gate module. A conduit encloses power lines and communication lines connecting the mounted modules. The conduit is carried by the rail. The module group may also comprise a vehicle sensor and/or a camera. The power and communication lines connect with a communication power cabinet. Some of the modules operate in conjunction with vehicle sensors.

A vehicle gate installation includes a vehicle travel lane. A rail adjacent the vehicle travel lane is elevated above the travel lane. A gate module has a gate which is movable over the travel lane to obstruct vehicle movement. An identification module adjacent the rail identifies the vehicle or the vehicle operator in the travel lane. A conduit encloses at least one power line and at least one communication line connecting the gate module and the identification module. The conduit is carried by the rail at the protected side of the rail.

The modularity allows for numerous embodiments. An anti-tailgate module is disposed adjacent the rail. At least one power line connects the anti-tailgate module. A vehicle sensor, which connects to a power line and a communication line carried by the rail, is also employed. A camera has a field of view traversing across the travel lane. The rail has an impact side and a protected side with elongated channels. The conduit is preferably disposed in a channel of the rail.

A method for providing power and communication to a vehicle gateway system for regulating traffic in a travel lane comprises providing an elevated rail adjacent the travel lane, and installing at least one power line and a communication line in a conduit. The method further comprises mounting the conduit to the rail on a protected side of the rail. The installation method further comprises positioning modules on the protected side of the rail and connecting the power line and communication line to the modules. The method preferably comprises mounting the conduit in a channel of the protective rail.

DETAILED DESCRIPTION

With reference to the drawings wherein like numerals represent like parts throughout the several figures, a modular gate system especially adapted for controlling vehicle access and/or vehicle egress to and from a controlled facility is generally designated by the numeral 10. The modular gate system typically employs an exit gate section 12 and an entrance gate section 14 for a vehicle travel lane 16. For some embodiments, only an exit or an entrance installation is provided.

Figure 1:
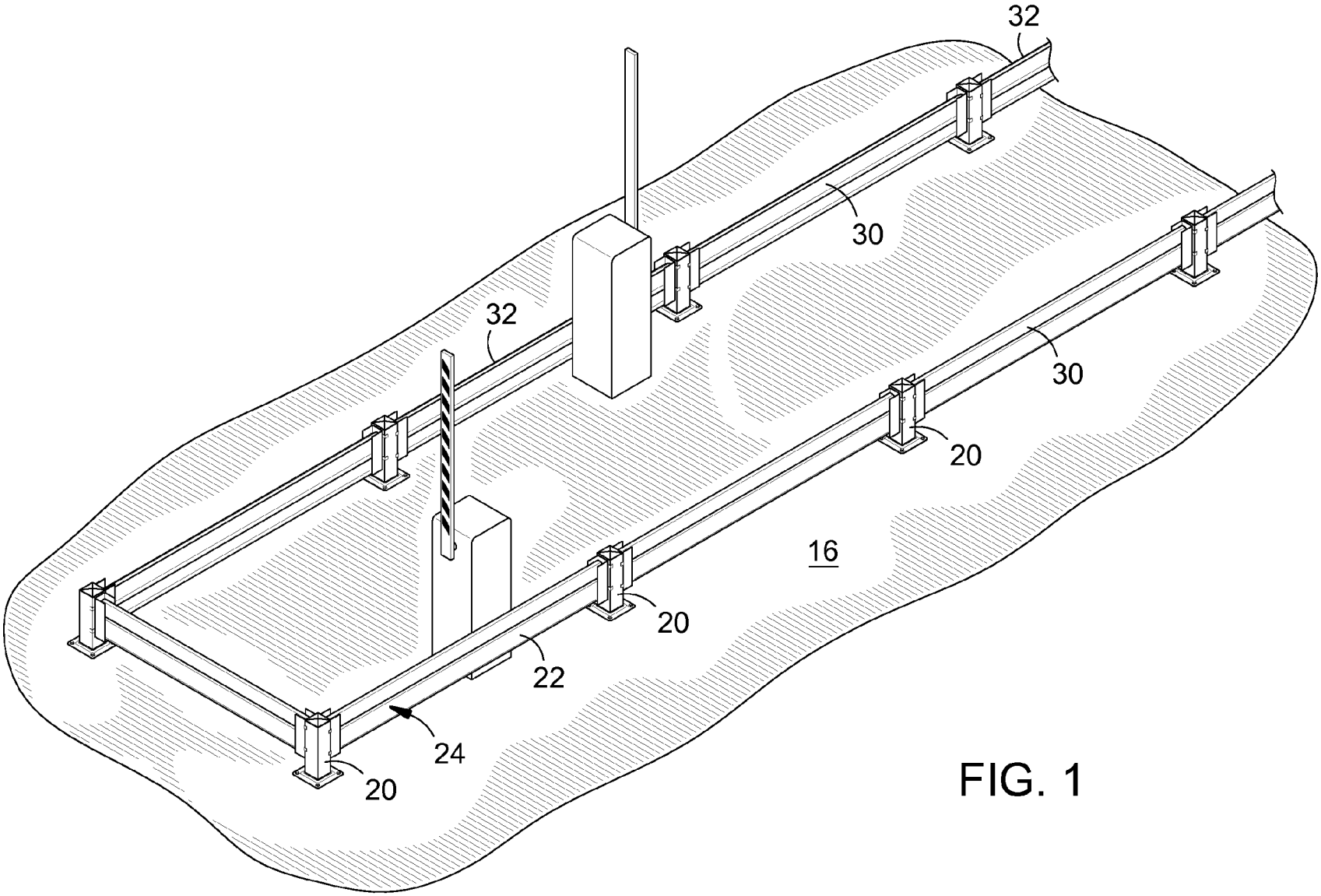
FIG. 1 is a perspective view of a representative modular gate system.
Figure 2:
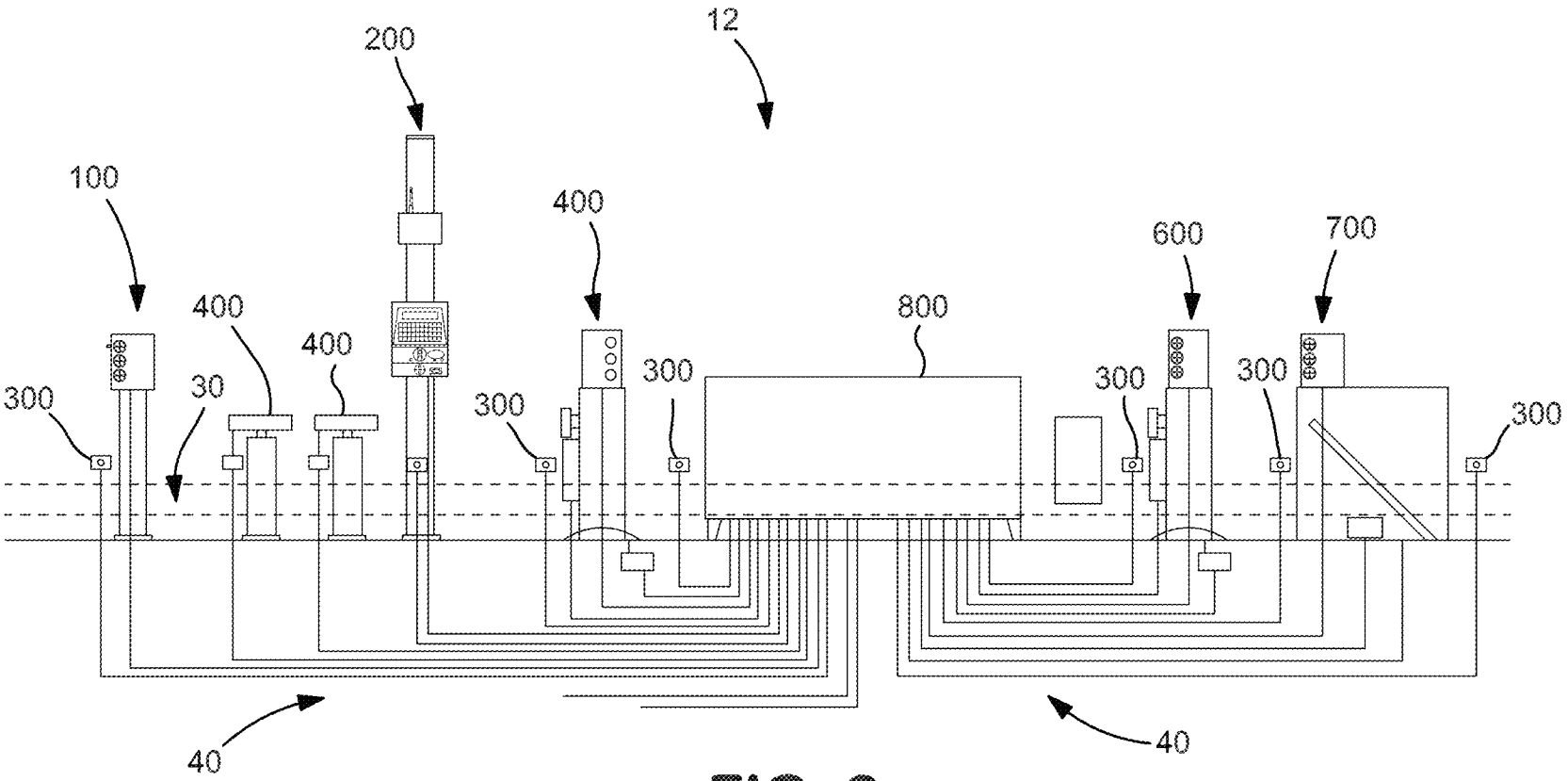
FIG. 2 is an annotated side elevational view, partly in schematic, of an exit gate section of a modular gate system and further illustrating a one-line, low voltage wiring diagram.
Figure 3:
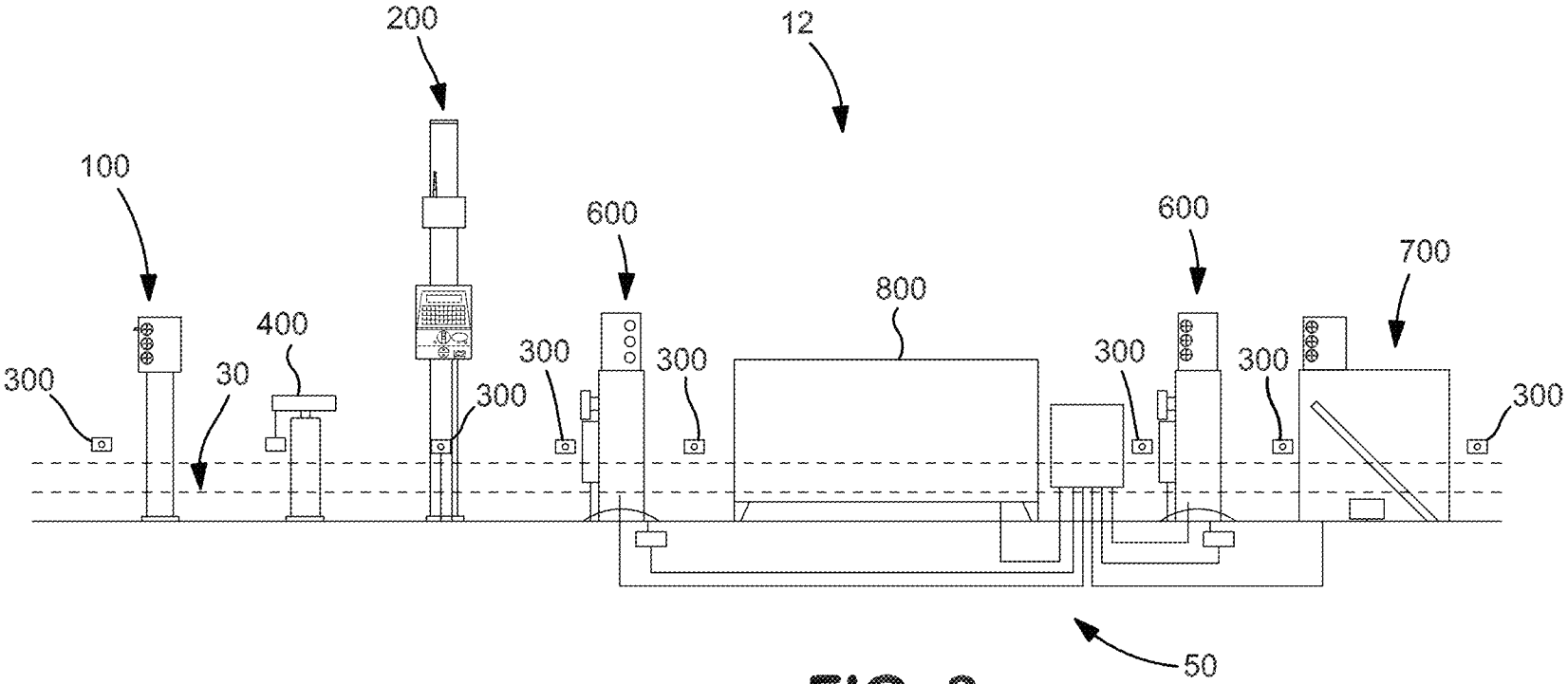
FIG. 3 is an annotated elevational view, partly in schematic, of the exit gate section for the modular gate system of FIG. 2 and further illustrating a one-line, high voltage wiring diagram.

A plurality of longitudinally spaced stanchions 20 mount a plurality of rail members 22 each having at least one longitudinal reinforced channel 24. The rail units and stanchions are connected and integrated to form an elevated rail 30 which extends along one side of a travel lane. Rail 30 preferably has the form of a highway guardrail with an impact side generally facing the travel lane and an opposite protected side 32. For convenience, the rail 30 is schematically illustrated in broken lines in FIGS. 2, 3 and 5. The rail 30 functions to support, connect and/or attach the various modules, as will be described below, as well as to carry the hardwired power and communication lines for the modules.

For any given facility, various modules can be selected and mounted to, adjacent and/or against the rail 30 and electronically connected via various connections along the rail. Underground and/or subfloor hardwiring is not required.

Figure 4:
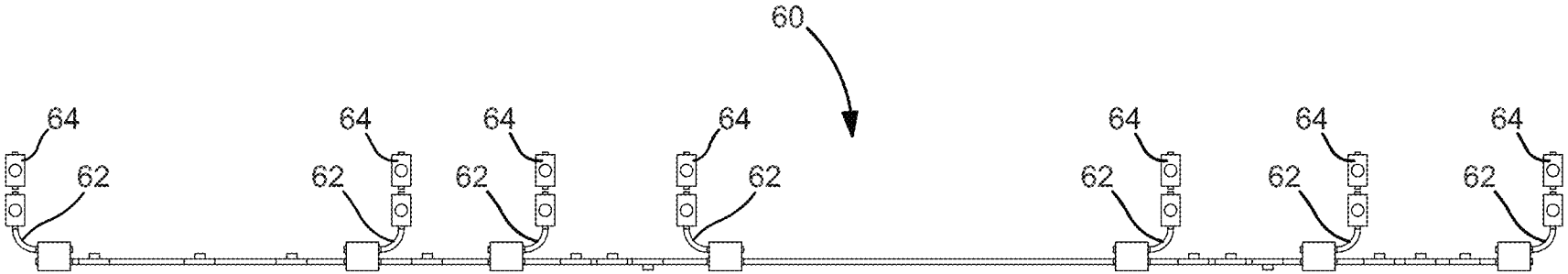
FIG. 4 is a fragmentary view of the electrical conduits employed for the modular gate system of FIGS. 2 and 3.
Figure 5:
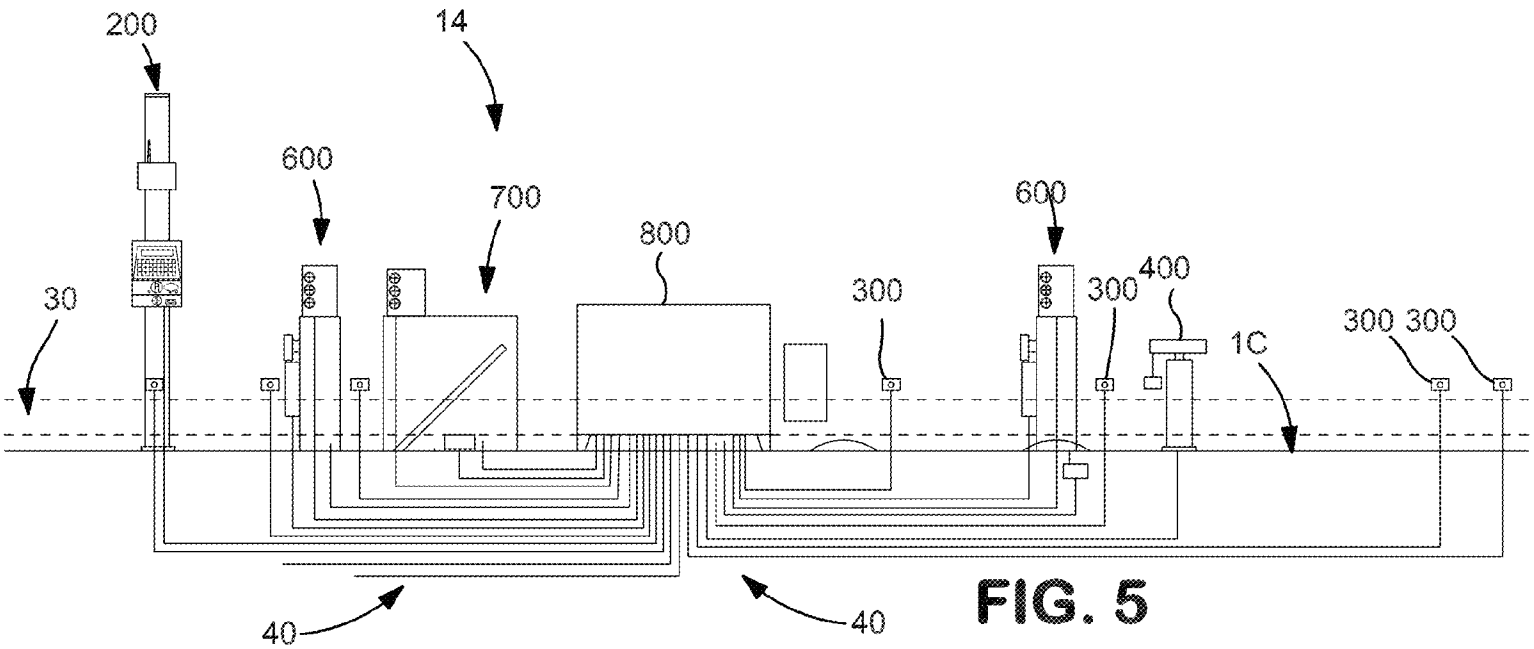
FIG. 5 is an annotated elevational view, partly in schematic, of an entrance gate section of a modular gate system and further illustrating a one-line, low voltage wiring diagram.
Figure 6:
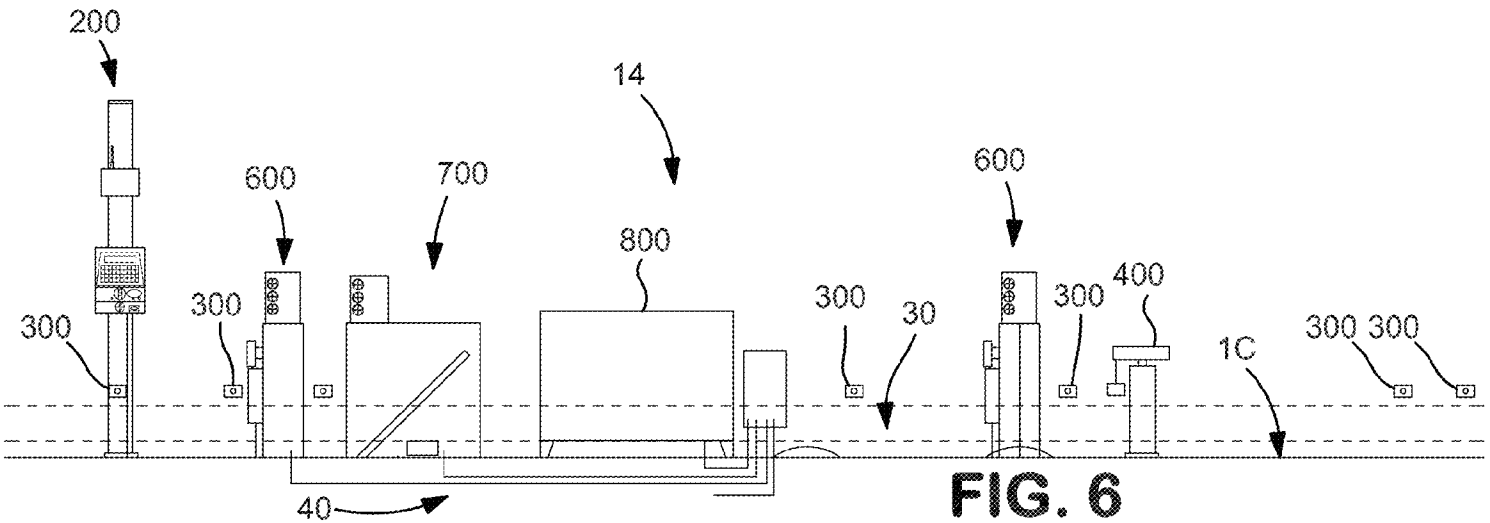
FIG. 6 is an annotated elevational view, partly in schematic, of the entrance gate section of the modular gate system of FIG. 5 and further illustrating a one-line, high voltage wiring diagram.

The low voltage wiring designated generally as 40 and high voltage wiring designated generally as 50 for communication and power, respectively, are carried in a conduit 60 (FIG. 4) or multiple conduits. The diagrams of wiring 40 and wiring 50 illustrated in FIGS. 5 and 6 are not intended to show or suggest that the wiring is underground or below the support surface of the gate system 10. To the contrary, the wiring 40 and 50 is principally disposed in conduits carried by the rail disposed above the level of the ground or the travel lane 16. Each conduit is an integrated protective assembly which preferably substantially extends the length of the rail and is carried by the rail at the protected side 32 of the rail. The conduit 60 is preferably received and securely mounted in a longitudinal channel 24 of the rail. Various junction elbows 62 and junction boxes 64 are provided as needed for a given installation configuration.

Figure 7D:
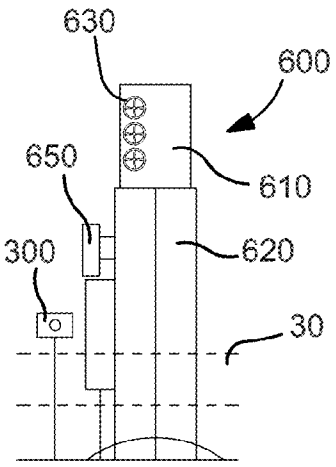
FIGS. 7 A-E are enlarged elevational views of representative modules and an adjacent rail for a modular gate system.
Figure 7C:
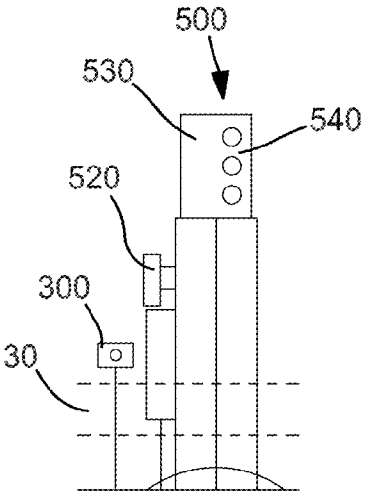
Figure 7E:
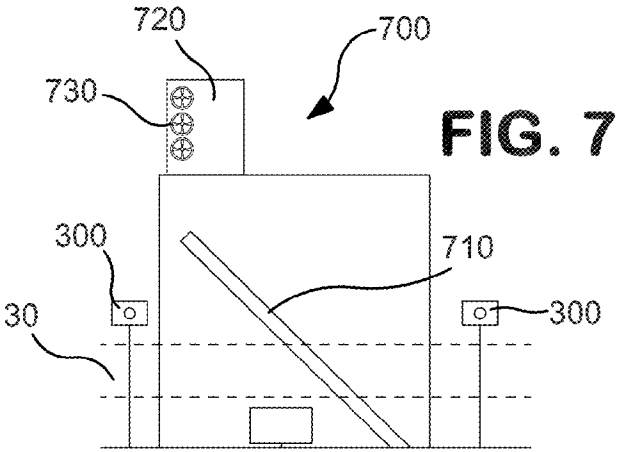

Among the various modules preferably mounted and connected to the rail 30 are an anti-tailgate module 100 (FIG. 7A), an operator identification terminal 200 (FIG. 7B), a vehicle sensor module 300, a camera module 400, a stop gate module 500 (FIG. 7C), an exit gate module 600 (FIG. 7D) and an exit barrier module 700 (FIG. 7E). Other modules are also possible. Each of the modules ultimately connect with a central command station or communication power cabinet 800. Some of the modules may be isolated for independent operation.

The vehicle sensor modules 300 and camera modules 400 may be directly mounted to the rail 30 with their communication lines being carried by conduit 60. For some embodiments, the personal identification module is simply a card reader, an RFID reader, a bioreader or an input device for entering a name or a code.

Figure 7B:
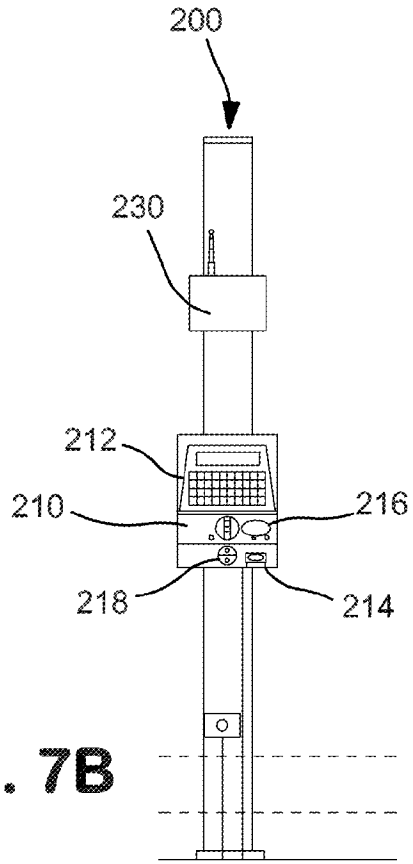
Figure 7A:
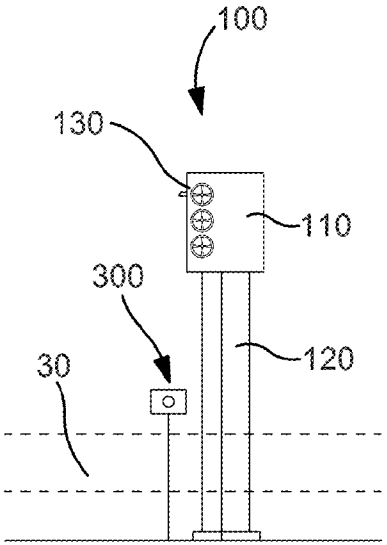

With reference to FIG. 7A, an anti-tailgate module 100 includes a cabinet 110 mounted to the top of a post 120. The post 120 is mounted against the rail 30. The cabinet 110 includes a red light, yellow light, and green light traffic light control 130 for signaling to warn the vehicle operator against tailgating into the entrance through the exit assembly. A vehicle sensor 300 is also employed in conjunction with the anti-tailgate module 100. The power and communication lines for the anti-tailgate module 100 connect via the wires in the conduit 60 with the station 800 or other connection module.

With reference to FIG. 7B, a personal identification module 200 includes a terminal 210 with a keyboard 212 and a card reader 214, as well as a button and microphone 216 to provide audio communication. The terminal 210 is mounted to a tower 220 mounted against the rail 30. External remote communication is provided by a cell phone module 230 at the top of the tower 220. In addition, a bio-reader (not illustrated), as well as an RFID reader 218 may be provided. The communication line for the personal identification module 200 is carried in conduit 60. The communication lines for module 600 are carried in conduit 60.

With reference to FIG. 7C, a stop gate module 500 includes a stanchion 510 which mounts an arm-like gate 520. In a lower active position, the gate 520 obstructs passage until proper personal identification and vehicle identification has been provided. The stop gate also has a cabinet 530 with red, yellow and green lights 540 to indicate the operational status for exiting to the next area. The exit gate 520 is automatically lowerable and retractable to control passage of a vehicle. At least one vehicle sensor 300 is also employed in conjunction with the module 500. The power and communication lines for the stop gate are carried in conduit 60.

With reference to FIG. 7D, the exit gate module 600 includes a cabinet 610 with red, yellow and green traffic control lights 630. The cabinet 610 is mounted at the top of a stanchion 620 which also mounts an arm-like gate 650 which is lowerable to obstruct the vehicle and retractable to permit passage. At least one vehicle sensor 300 is also employed in conjunction with module 600.

With reference to FIG. 7E, an exit barrier module 700 includes a barrier 710 which may be pivoted from the pavement level of the travel lane to prevent exiting from the facility unless the proper identification has been provided. The exit barrier also includes a cabinet 720 with red, yellow and green traffic control lights 730. Two vehicle sensors 300 on opposite sides of the barrier are employed in conjunction with the barrier gate. The power and communication lines for module 700 are carried in conduit 60.

It should be appreciated that for the modules which require power to operate the gates or the barriers, the high power wiring 50 is provided through the conduits 60 which are mounted to the rail 30.

Figure 8:
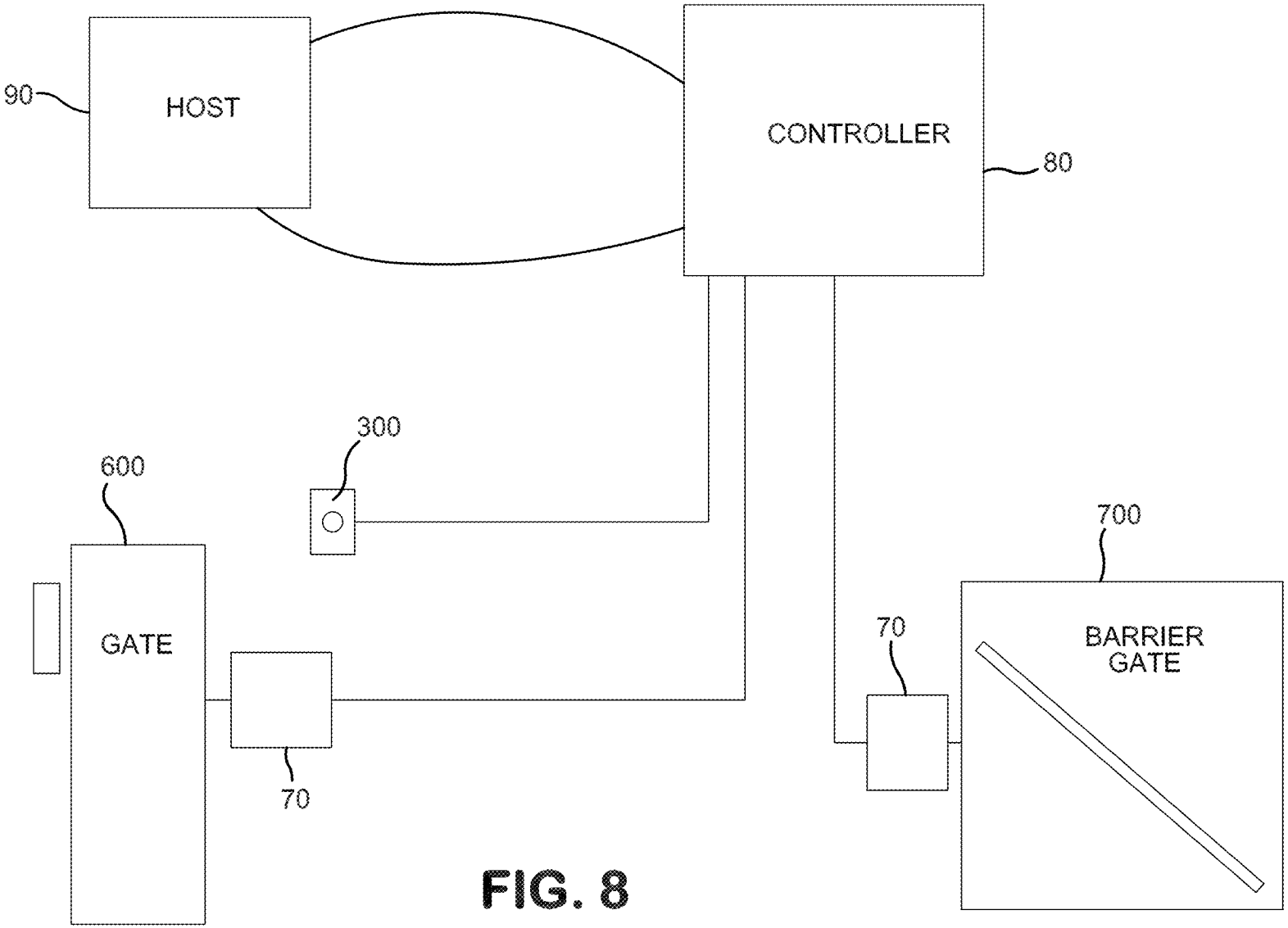
FIG. 8 is a schematic block diagram for representative portions of a modular gate system.

With reference to FIG. 8, each of the modules which require motive force includes an interface box 70. Each interface box 70 connects with a controller 80 which connects over the internet or via wireless communication or otherwise with a host 90 for providing isolated control over the operation of each active module, such as exit gate module 600 and barrier gate module 700.

While preferred embodiments have been described, the foregoing description should not be deemed a limitation of the invention herein. Accordingly, various modifications, adaptations and alternatives may occur to one skilled in the art without departing from the spirit and the scope of the present invention.

The invention claimed is:

1. A modular vehicle gate system comprising:

an enclosure within a controlled vehicle facility defined by a closed off area further defined by a rail system comprising a plurality of supports and at least one rail unit supported by said supports to extend generally linearly to define an elevated rail which is separated from the controlled vehicle facility by the rail system;

at least two modules disposed in said enclosure adjacent to said rail at spaced positions along said rail, said modules selected from the group consisting of an anti-tailgate module, a personal identification module, a vehicle identification module, a gate module and a barrier gate module; and a conduit enclosing at least one power line or at least one communication line connecting said mounted modules, said conduit being mounted to said rail.

2. The modular vehicle gate system of claim 1 further comprising a vehicle sensor and a camera mounted at spaced positions along said elevated rail.

3. The modular vehicle gate system of claim 1 and further comprising a power cabinet and wherein each power line is enclosed in a conduit and each communication line is enclosed in a conduit and each power and communication line connects with the communication power cabinet.

4. The modular vehicle gate system of claim 1 wherein at least one module operates in conjunction with a vehicle sensor.

5. The modular vehicle gate system of claim 1 wherein said conduit encloses at least one power line and at least one communication line.

6. The modular vehicle gate system of claim 1 further comprising a connecting conduit connecting a rail mounted conduit and a module.

7. A vehicle gate installation comprising:

an enclosure within a controlled vehicle facility adjacent a vehicle travel lane, said enclosure defined by a closed off area further defined by a rail adjacent said vehicle travel lane and elevated above said travel lane and which enclosure is separated from a portion of the controlled vehicle facility;

a gate module disposed in said enclosure and having a gate which is moveable over said travel lane to obstruct vehicle movement;

an identification module disposed in said enclosure adjacent said rail for identifying a vehicle or a vehicle operator in said travel lane; and a conduit enclosing at least one power line and at least one communication line connecting said gate module and said identification module, said conduit being mounted to said rail.

8. The installation of claim 7 further comprising an anti-tailgate module disposed adjacent said rail, said at least one power line connecting said anti-tailgate module.

9. The installation of claim 7 further comprising a vehicle sensor, a power line and a communication line connecting said vehicle sensor and mounted to said rail.

10. The installation of claim 7 further comprising a camera having a field of view traversing across said travel lane, a power and a communication line connecting said camera.

11. The installation of claim 7 wherein said rail has an impact side and a protective side and said conduit is disposed at said protected side.

12. The installation of claim 7 wherein said rail has an elongated channel and said conduit is disposed in said channel.

13. The installation of claim 7 and further comprising another module and a second conduit connecting between said conduit and said another module.

* * * * *